US006855248B1

(12) United States Patent
Olivier et al.

(10) Patent No.: US 6,855,248 B1
(45) Date of Patent: Feb. 15, 2005

(54) PROCESS FOR DISTILLING FISCHER-TROPSCH DERIVED PARAFFINIC HYDROCARBONS

(75) Inventors: Anthony John Olivier, Sasolburg (ZA); Ferdinand Richter, Hamburg (DE); Charles Duckitt, Sasolburg (ZA); Ashwin Ramduth, Sasolburg (ZA); Vernon Jeremay Adams, Sasolburg (ZA); Vinothen Moodley, Mossel Bay (ZA); Roy Alexander Calder, Randburg (ZA); Mario Roza, St. Cerque (CH)

(73) Assignees: Sulzer Chemtech Limited, Winterthur (CH); Sasol Wax (South Africa) (Proprietary) Limited, Johannesburg (ZA)

( * ) Notice: Subject to any disclaimer, the term of this patent is extended or adjusted under 35 U.S.C. 154(b) by 0 days.

(21) Appl. No.: 09/537,250

(22) Filed: Mar. 28, 2000

Related U.S. Application Data

(63) Continuation of application No. PCT/IB99/01448, filed on Aug. 19, 1999.

(30) Foreign Application Priority Data

Aug. 21, 1998 (ZA) ..... 98/7599

(51) Int. Cl.[7] ..... C10G 29/00; C10G 45/00; C10G 17/06; B01D 3/10

(52) U.S. Cl. ..... 208/366; 208/247; 208/263; 203/DIG. 25

(58) Field of Search ..... 108/347; 203/DIG. 25; 208/366, 363, 347

(56) References Cited

U.S. PATENT DOCUMENTS

| | | | | |
|---|---|---|---|---|
| 1,740,125 A | | 12/1929 | Sullivan, Jr. | 208/30 |
| 2,467,959 A | | 4/1949 | Bowman et al. | 196/17 |
| 2,852,546 A | | 9/1958 | Kolling et al. | 260/450 |
| 3,767,564 A | * | 10/1973 | Youngblood et al. | 208/92 |
| 3,886,062 A | * | 5/1975 | Peiser et al. | 208/354 |
| 4,295,936 A | * | 10/1981 | Farnham | 202/153 |
| 5,178,747 A | * | 1/1993 | Blackburn et al. | 208/14 |
| 5,447,628 A | * | 9/1995 | Harrison et al. | 208/179 |
| 5,486,542 A | | 1/1996 | Posthuma et al. | 517/700 |

FOREIGN PATENT DOCUMENTS

EP 0081895 A * 6/1983

* cited by examiner

*Primary Examiner*—Walter D. Griffin
*Assistant Examiner*—Tam Nguyen
(74) *Attorney, Agent, or Firm*—Ladas & Parry LLP

(57) ABSTRACT

A process for distilling paraffinic hydrocarbons comprises feeding a Fischer-Tropsh derived paraffinic hydrocarbon feedstock comprising heavy paraffinic hydrocarbons and, optionally, light and/or medium paraffinic hydrocarbons, into a distillation column. The distillation column is operated to produce usable waqx products. An overhead stream, a bottom stream, and at least one side stream, are withdrawn from the distillation column. All the wax products obtained are usable wax products.

10 Claims, 1 Drawing Sheet

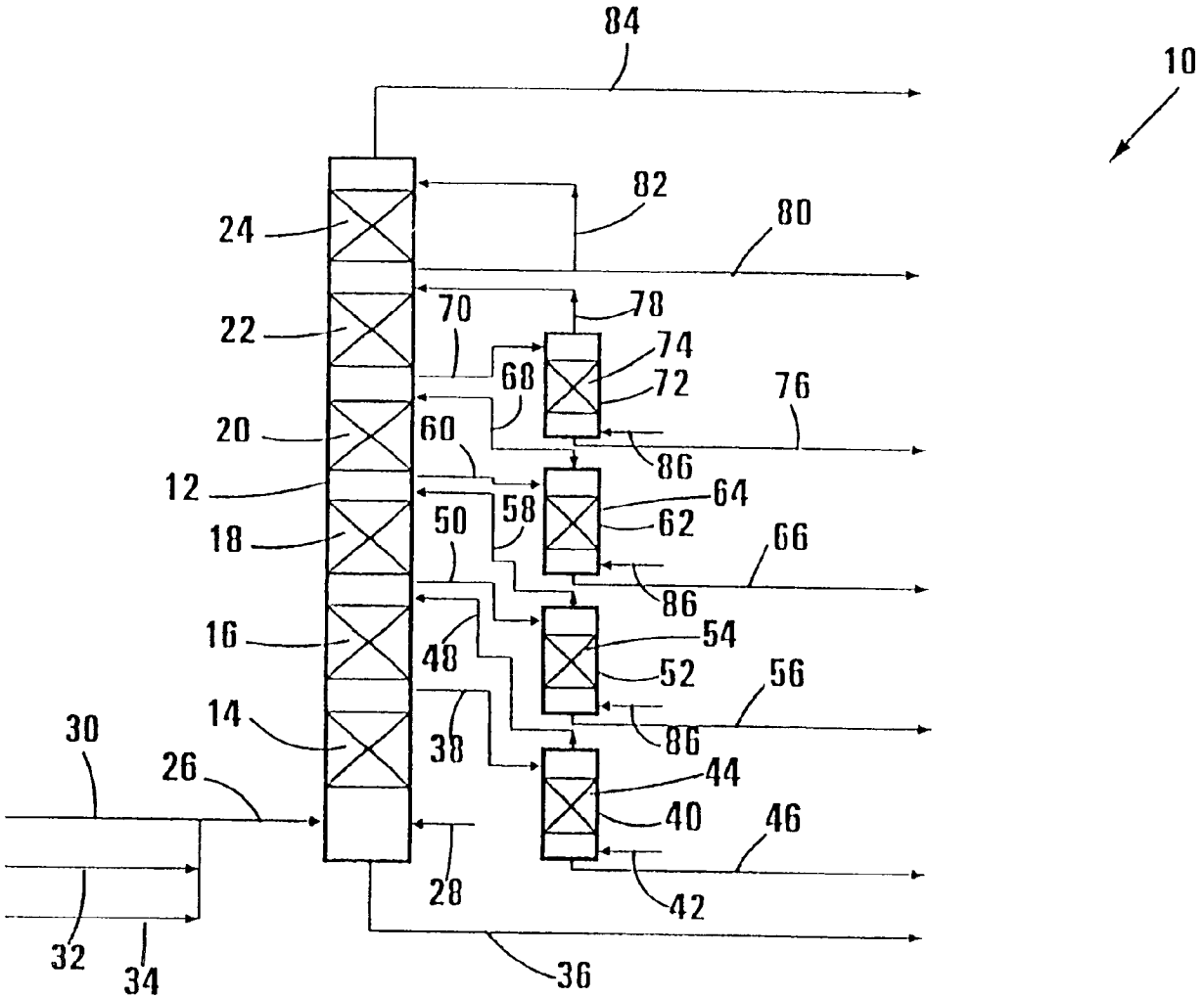
10
84
82
80
78
76
74
72
70
68
66
64
62
60
58
56
54
52
50
48
46
44
42
40
38
36
34
32
30
28
26
24
22
20
18
16
14
12
86
86
86

PROCESS FOR DISTILLING FISCHER-TROPSCH DERIVED PARAFFINIC HYDROCARBONS

This application is a continuation of PCT/IB99/01448 filed Aug. 19, 1999.

This invention relates to distillation. More particularly, the invention relates to a process for distilling paraffinic hydrocarbons, particularly Fischer-Tropsch derived paraffinic hydrocarbons to obtain the usable wax products.

According to the invention, there is provided a process for distilling paraffinic hydrocarbons, which process comprises feeding a Fischer-Tropsch derived paraffinic hydrocarbon feedstock comprising heavy paraffinic hydrocarbons and, optionally, light and/or medium paraffinic hydrocarbons, into a distillation column;

operating the distillation column to produce usable wax products; and withdrawing from the distillation column an overhead stream, a bottom stream comprising usable wax products, and at least one side stream comprising usable wax products.

The usable wax products are thus Fischer-Tropsch derived.

Fischer-Tropsch derived wax products must usually meet stringent specifications for several properties or characteristics. Some of the more important of such properties or characteristics are the congealing point, softness at various temperatures (measured by needle, penetration), oil content (measured by the wax product solubility in methyl-ethyl-ketone (MEK) or methyl-isobutyl-ketone (MIBK) solvents) and olefin content (measured using a bromine index). Also of importance are DSC (Differential Scanning Calorimetry) curves (these are 'finger prints' of wax showing the energy absorption as a function of temperature) and GPC (Gel Permeation Chromatography) data. GPC data are a measure of molecular weight, the heavy tail and the light ends that are present in a wax.

By 'usable' in respect of the wax products is meant that the wax products are non-thermally degraded. The wax products will also meet the stringent specifications of some or most of the properties or characteristics hereinbefore set out.

By 'Fischer-Tropsch derived' in respect of the paraffinic hydrocarbon feedstock, is meant paraffinic products obtained by subjecting a synthetic gas comprising carbon monoxide (CO) and hydrogen ($H_2$) to Fischer-Tropsch reaction conditions in the presence of an iron-based, a cobalt-based or an iron/cobalt-based Fischer-Tropsch catalyst.

Prior to using the products from the Fischer-Tropsch reaction as a feedstock for the present process, they may optionally be hydrogenated. Such hydrogenation may be effected by contacting the Fischer-Tropsch reaction products with hydrogen in the presence of a hydrogenation catalyst, at elevated temperature and pressure, in known fashion.

Fischer-Tropsch derived wax products are unique since they are predominantly n-paraffinic with a wide boiling range. Some isomers, olefins, oxygenates and other functional groups may also be present. The high n-paraffinic content of Fischer-Tropsch waxes enables them to meet the stringent specifications hereinbefore referred to. Thermal degradation, even in its mildest form of less than 2%, will cause an increase in isomer and olefin content which may immediately render the wax product non-usable.

The Fischer-Tropsch reaction conditions include using a relatively low reaction temperature in the range 180–300° C., typically 210–260° C., so that a so-called low temperature Fischer-Tropsch synthesis is employed, and the Fischer-Tropsch reaction is typically effected in a fixed or slurry bed reactor.

The feedstock may comprise, in addition to the heavy paraffinic hydrocarbons, the light and the medium paraffinic hydrocarbons. The feedstock could thus typically have a true boiling point curve as indicated in Table 1:

TABLE 1: True boiling point (TBP) curve of a typical Fischer-Tropsch derived feedstock

| Mass % | TBP (° C.) |
|---|---|
| 1 | 142 |
| 5 | 169 |
| 10 | 195 |
| 30 | 313 |
| 50 | 417 |
| 70 | 550 |
| 90 | 716 |
| 95 | 757 |
| 98 | 831 |

The feedstock typically comprises hydrocarbon molecules in the range $C_3$+ to $C_{220}$+. Products with carbon ranges of $C_{35-}$, $C_{10}$ to $C_{80}$, and $C_{15}$ to $C_{220}$ or higher, are deemed light, medium and heavy hydrocarbons respectively.

The distillation column can be operated to produce paraffins ($C_{23-}$), medium wax ($C_{20}$ to $C_{38}$), and hard wax ($C_{30}$+) or combinations thereof. All the wax products produced will thus be usable wax products as hereinbefore defined.

Preferably, however, a plurality of side streams are withdrawn from the column, with each side stream comprising a component of the medium wax and/or a component of the hard wax, and, optionally, a component of the paraffins.

The distillation column is preferably operated under vacuum operation under vacuum permits a n-paraffinic hydrocarbon to boil at a lower temperature as compared to at atmospheric pressure. The lower temperature decreases, if not eliminates, thermal degradation of the feedstock and the products.

The distillation column may be operated such that the pressure in the column is in the range of 1 to 12 mbar (a), typically from 8–10 mbar (a). The temperature in the column sump may then be in the range of 190° C. to 350° C., typically in the range of 295° C. to 350° C.

The process may include feeding stripping steam into the distillation column, to adjust the relative volatility of components in the feedstock. The process may also include feeding one or more of the side streams through a stripping stage. It is envisaged that steam stripping can be used to adjust the front end volatility of the products, thereby to aid in product quality.

The distillation column will thus have a suitable internal arrangement. The internal arrangement may comprise trays or packing as distillation media. However, for vacuum distillation applications, the pressure drop over the required number of theoretical stages should be minimized to prevent or inhibit thermal degradation of distilled products. Additionally, packing generally results in lower pressure drops than trays for the same number of theoretical stages and the same vapor/liquid traffic in the distillation column. According to Distillation Design, by Henry Z. Kister, McGraw Hill, 1992 (hereinafter also referred to as 'Kister'), a vacuum distillation column with ten theoretical stages and operating at a 1 psi (about 70 mbar) top pressure, has a bottom pressure of 2,5 psi (about 175 mbar) when fitted with trays; however, the bottom pressure is only 1,4 psi (about 100 mbar) when it contains packing.

Packing is thus preferred as distillation medium. The packing may be random or dumped packing, according to Kister, discrete pieces of packing of a specific geometrical shape and which are dumped or randomly packed into the column; structured or systematically arranged packing, ie, according to Kister, crimped layers of wire mesh or corrugated sheets, with sections of such packing then being stacked in the column; and grid packing, ie, according to Kister, systematically arranged packing, but having an open-lattice structure rather than being in the form of wire mesh or corrugated sheets. The preferred internal arrangement comprises structured packing, in view of its superior balance of efficiency, capacity and pressure drop as compared to the other packings hereinbefore described.

The structured packing may have a surface area (in $m^2$) to volume (in $m^3$) ratio of 125:1 to 750:1, e.g. 250:1, 350:1 or 500:1, or any other intermediate value.

As indicated hereinbefore, a plurality of the side streams may be provided, with the distillation column including a draw point or zone for each of the side streams as well as for the overhead and bottom streams, and with a plurality of distillation stages being provided in the distillation column, with each stage being located between the draw points or zones for two of the streams. Each stage may thus comprise the structured packing.

This packing and column internal arrangement produces a very low pressure drop and decreases entrainment while ensuring that the required separation is achieved. This low pressure drop permits the addition of more column side draws or theoretical stages than would be the case if different column internals with higher pressure drops were to be used.

Typically, five theoretical stages are provided per bed of packing, with the respective beds each containing the packing and the internal arrangement, and each bed being located between draw points for the overhead, side and bottom streams from the column. The packings of the various beds and stages can have the same surface area to volume ratios, or the surface area to volume ratios of the packings of at least some of the beds and/or stages can be different. The internal arrangement minimizes the residence time within the distillation column, thus reducing the amount of thermal cracking of the products produced.

The process of the invention thus employs multiple side streams with separation stages in the column between the withdrawal of the side streams, to split wax fractions.

Thermal degradation can be further countered by cooling down the bottom stream, and recycling a small proportion, typically less than 10% by volume, of the cooled bottoms product to the column sump to quench the sump content. This can be done without appreciably effecting the front end cut of the column bottoms product or the tail end of the column side stream or draw-off immediately above the column bottoms product, ie the stringent specifications hereinbefore referred to can still be met.

With the process of the invention, the Fischer-Tropsch derived feedstock is thus fractionated into product streams having unique properties or characteristics. One of these properties is the congealing point, which can thus be used to control the operation of the distillation column.

However, instead, or additionally, other unique properties, such as methyl-ethyl-ketone (MEK) and/or methyl-isobutyl-ketone (MIBK) solubles (also referred to as the oil content), penetration at a particular temperature, which is normally in the range of 25° C. to 60° C., carbon distributions, etc. can be used to control distillation operation. The number of side streams from the column are determined by the properties of the products and by-product purity desired. There is, in principle, no restriction on the maximum number of side stream product draws other than the fact that the accumulated pressure drop of the internals must be limited.

It was surprisingly found that with the unique process according to the invention, Fischer-Tropsch feedstocks can be distilled into usable wax products in a single column that has one or more side streams. The use of the low pressure drop internals, stripping stream and/or the quenching of the contents of the column sump using cooled column bottoms product, inhibits or counters thermal degradation of the usable wax products.

The invention will now be described by way of example, with reference to the accompanying drawing and non-limiting example.

In the drawing, reference numeral 10 generally indicates, in simplified flow diagram form, a process according to the invention for distilling paraffinic hydrocarbons.

In the drawing, reference numeral 10 generally indicates a process according to the invention, for distilling a Fischer-Tropsch derived light, medium and heavy paraffinic hydrocarbon feedstock.

The process 10 includes a distillation column 12 having six vertically staggered packing stages 14, 16, 18, 20, 22 and 24. Each packing stage comprises high performance structured packing and associated internals such as structured packing having a surface area (in $m^2$) to volume (in $m^3$) ratio of 125:1, 250:1, 350:1, 500:1 or 750:1, or any appropriate intermediate value.

A feed line 26 leads into the bottom of the distillation column 12, as does a stripping steam feed line 28. Into the line 26 leads a light ($C_{20-}$) hydrocarbon line 30, a medium ($C_{10}$–$C_{40}$) hydrocarbon line 32 and a heavy ($C_{15}$–$C_{220}$+) hydrocarbon line 34.

The feed line 26 and the stripping steam feed line 28 lead into the column below the lowermost packing stage 14.

A bottoms line 36 leads from the bottom of the column 12.

A side stream line 38 leads from the column between the packing stages 14, 16 to a stripping column 40, with a stripping steam line 42 leading into the bottom of the column 40. The column 40 comprises a packing stage 44 comprising sieve trays. A product line 46 leads from the bottom of the column 40, while a return line 48 leads from the top of the column 40. The return line 48 returns to the column 12 between the packing stages 16, 18.

A side stream withdrawal line 50 leads from the distillation column between the packing stages 16, 18 into a stripping column 52 having a packing stage 54 comprising sieve trays. A product withdrawal line 56 lead from the bottom of the column 52, while a return line 58 leads from the top of the column 52 back to the distillation column 12 between the packing stages 18, 20.

A side stream withdrawal line 60 leads from the column 12 between the packing stages 18, 20. The line 60 leads into the top of a stripping column 62 having a packing stage 64 comprising sieve trays. A product withdrawal line 66 leads from the bottom of the column 62, while a return line 68 leads from the top of the column 62 back to the distillation column 12 between the packing stages 20, 22.

A side stream withdrawal line 70 leads from the distillation column 12 between the packing stages 20, 22. The line 70 leads into a stripping column 72 having a packing stage 74 comprising sieve trays. A product withdrawal line 76 leads from the bottom of the column 72, while a return line 78 leads from the top of the column 72 back to the distillation column 12, between the packing stages 22, 24.

A side stream/product withdrawal line 80 leads from the distillation column 12 between the packing stages 22, 24, and is fitted with a recycle line 82 returning to the distillation column 12 above the packing stage 24.

An overheads line 84 leads from the top of the column.

In use, a Fischer-Tropsch derived light, medium and heavy hydrocarbon feedstock is fed, along the flow line 26, into the bottom of the distillation column 12. The distillation column 12 is typically operated at a pressure of 8–10 mbar (a) and at a temperature, measured in the column sump, of about 295–300° C.

Usable wax products, such as medium wax ($C_{20}$–$C_{38}$) and hard wax ($C_{30+}$) are produced in the column 12.

The products withdrawn along the lines 36, 46, 56, 66, 76, 80 and 84 typically comprise $C_{35}$+, $C_{25}$–$C_{40}$, $C_{20}$–$C_{30}$, $C_{19}$–$C_{23}$, $C_{18}$–$C_{20}$, $C_{17-}$and $C_{5-}$respectively.

Stripping steam lines 86 lead into the bottoms of each of these stripping columns 52, 62, 72.

The following non-limiting examples were also conducted, in simulations of the process 10:

EXAMPLE 1

The feedstock entering the column 12 along the line 26 comprised light hydrocarbons (also known and referred to as Cold Condensate (CC)), medium hydrocarbons (also known and referred to as Hot Condensate (HC)) and heavy hydrocarbons (also known and referred to as Reactor Waxes (RW)). All the hydrocarbons were Fischer-Tropsch derived. Thus, each component of the feedstock was a blend of the respective products from both fixed and slurry bed reactor Fischer-Tropsch processes. The blend ratio (mass basis) in this example was:

CC = 28.8%
HC = 17.2%
RW = 54.0%

The number of side streams from the column 12 are determined by the properties of the product or the by-product purity desired.

There is no restriction on the maximum number of side product streams other than the fact that the accumulated pressure drop of the internals must be limited. If unlimited, energy loss and thermal cracking can be so significant that the process becomes technologically and/or economically non-viable.

Table 2 hereunder shows the streams produced, the desired congealing point (CP) range and typical CP values obtained.

TABLE 2

| | Product | Name | CP Desired Range (° C.) | Typical CP obtained (° C.) | Carbon No Range |
|---|---|---|---|---|---|
| Overhead Stream 84 | $C_{5-}$ | Gas | n/a | n/a | 5 max |
| Stream 80 | $C_{17-}$ | $C_{17}$-Paraffins | n/a | n/a | 4–18 |
| Stream 76 | $C_{18}$–$C_{20}$ | $C_{18}$–$C_{20}$ Paraffins | 25–30 | 28 | 17–21 |
| Stream 66 | $C_{19}$–$C_{23}$ | Waksol | 35–40 | 38 | 18–24 |
| Stream 56 | $C_{20}$–$C_{30}$ | Medium Wax 1 | 50–55 | 53 | 19–30 |
| Stream 46 | $C_{25}$–$C_{40}$ | Medium Wax 2 | 60–65 | 64 | 25–40 |
| Bottom Stream 36 | $C_{35+}$ | Hard Wax | 65+ | 98 | 35–220 |

The yield of the above streams on a mass basis as a percentage of the feed was approximately:

Overhead Stream 84 = 1.0%
Stream 80 = 27.6%
Stream 76 = 5.8%
Stream 66 = 4.5%
Stream 56 = 6.9%
Stream 46 = 11.4%
Bottom Stream 36 = 42.8%

The column 12 was operated at a head pressure of 5 mbar (a) using a three stage steam ejector for its vacuum system. The pressure drops achieved over the 6 beds of structured packing was 25 mbar. Each bed of packing comprised Mellapak 250Y (trade mark) packing available from Sulzer Chemtech Ltd, PO Box 65, CH-8404, Winterthur, Switzerland. Some side streams had side stripper columns as indicated in the drawing. Low pressure (2,4 $bar_g$) steam was injected into both the bottom of the main fractionator and the side stripper columns to aid in separation.

EXAMPLE 2

The feedstock entering the column 12 along the line 26 had the following composition:

RW = 79% by mass
HC = 21% by mass

The products obtained are given in Table 3.

TABLE 3

| | | TEST | GAS C5- | | C17-PARAFFINS | | WAXY OIL | |
|---|---|---|---|---|---|---|---|---|
| ANALYSES | UNITS | METHOD | Spec | Typical | Spec | Typical | Spec | Typical |
| Congealing Point | ° C. | ASTM938 | — | — | — | — | 26–30 | 28 |
| Cloud Point | ° C. | SASOL | — | — | — | — | — | — |
| Penetration at | | | | | | | | |
| 25° C. | 0.1 mm | ASTM D1321 | — | — | — | — | — | — |
| 40° C. | 0.1 mm | ASTM D1321 | — | — | — | — | — | — |
| 65° C. | 0.1 mm | ASTM D1321 | — | — | — | — | — | — |
| MEK Solubles | mass % | ASTM D721 | — | — | — | — | 22 max | 15 |
| MIBK Solubles | mass % | ASTM D721 | — | — | — | — | — | — |
| Saybolt Color (ASTM) | — | ASTM D156 | — | — | — | — | +10 min | +20 |
| Bromine Index | g Br/100 g | SASOL | — | — | — | — | 10 max | 7 |

TABLE 3-continued

| | | | | | | | | |
|---|---|---|---|---|---|---|---|---|
| DSC Analyses: | | SASOL | | | | | | |
| Melt range | ° C. | | — | — | — | — | — | — |
| Maximum | ° C. | | — | — | — | — | — | — |
| Fusion Enthalpy | J/g | | — | — | — | — | — | — |
| GPC Analyses: | | SASOL | | | | | | |
| Mn | Daltons | | — | — | — | — | — | 276 |
| Mw | Daltons | | — | — | — | — | — | 272 |
| Mz | Daltons | | — | — | — | — | — | 278 |
| Pd | Daltons | | — | — | — | — | — | 1.0 |
| ASTM D2887 Data: | | ASTM D2887 | | | | | | |
| IBP | ° C. | | — | — | — | — | — | — |
| 5% | ° C. | | — | — | — | 187 | 280–300 | 288 |
| 50% | ° C. | | — | — | — | 258 | — | 328 |
| 95% | ° C. | | — | — | — | 293 | 355–375 | 363 |
| FBP | ° C. | | — | — | — | — | — | — |
| Carbon Distribution: | | SASOL | | | | | | |
| Range | C number | | — | — | 4–18 | 5–18 | — | 13–23 |
| Peak | C number | | — | — | 12–13 | 13 | — | 22 |
| >C17 | mass % | | — | — | 0.15 max | 0.1 | — | — |
| Iso-paraffins | mass % | | — | — | — | — | — | — |

| | | TEST | MEDIUM WAX 1 + 2 BLEND | | HARD WAX | |
|---|---|---|---|---|---|---|
| ANALYSES | UNITS | METHOD | Spec | Typical | Spec | Typical |
| Congealing Point | ° C. | ASTM938 | 56–60 | 57 | 96–100 | 97 |
| Cloud Point | ° C. | SASOL | 72 max | 62 | — | — |
| Penetration at | | | | | | |
| 25° C. | 0.1 mm | ASTM D1321 | 24–32 | 26 | 1 max | <1 |
| 40° C. | 0.1 mm | ASTM D1321 | 120–130 | 128 | — | — |
| 65° C. | 0.1 mm | ASTM D1321 | — | — | 25 max | 20 |
| MEK Solubles | mass % | ASTM D721 | 3.2–4.2 | 4.0 | — | — |
| MIBK Solubles | mass % | ASTM D721 | — | — | 1.5 max | 0.8 |
| Saybolt Color (ASTM) | — | ASTM D156 | +10 min | +20 | +15 min | +17 |
| Bromine Index | g Br/100 g | SASOL | 1 max | 0.5 | 1 max | <0.1 |
| DSC Analyses: | | SASOL | | | | |
| Melt range | ° C. | | 3–7/58–63 | 6/60 | 19–22/111–114 | 21/112 |
| Maximum | ° C. | | 53–56 | 54 | 76–78/100–102 | 77/101 |
| Fusion Enthalpy | J/g | | 180–189 | 188 | 228–237 | 232 |
| GPC Analyses: | | SASOL | | | | |
| Mn | Daltons | | 351–379 | 365 | 636–664 | 650 |
| Mw | Daltons | | 363–391 | 365 | 799–827 | 813 |
| Mz | Daltons | | 370–398 | 372 | 1120–1148 | 1134 |
| Pd | Daltons | | 1.0–1.1 | 1.0 | 1.2 max | 1.1 |
| ASTM D2887 Data: | | ASTM D2887 | | | | |
| IBP | ° C. | | — | — | — | — |
| 5% | ° C. | | 345–365 | 356 | 465–485 | 475 |
| 50% | ° C. | | — | 412 | — | 636 |
| 95% | ° C. | | 485–505 | 490 | — | 819 |
| FBP | ° C. | | — | — | — | — |
| Carbon Distribution: | | SASOL | | | | |
| Range | C number | | — | 19–40 | — | 30–220 |
| Peak | C number | | — | — | — | — |
| >C17 | mass % | | — | — | — | — |
| Iso-paraffins | mass % | | 8 max | 5.9 | 4 max | 3.2 |

Product Yields (mass %):
Gas C5- = 0.1
C17- Paraffins = 5.1
Waxy Oil = 11.8
Medium Wax 1 for Blend = 12.7
Medium Wax 2 for Blend = 12.7
Hard Wax = 57.6

The column sump temperature was 300° C., and the head pressure was 5 mbar (a). The pressure drop achieved over the six beds of Mellapak 250Y packing was 15 mbar (a). All wax products met the stringent specifications for Fischer-Tropsch products and were consequently usable, as indicated in Table 3 above.

EXAMPLE 3

The feedstock entering the column 12 along line 26 had the following composition:

| |
|---|
| HC = 21% by mass |
| RW = 79% by mass |

The products obtained are given in Table 4.

TABLE 4

| | | TEST | GAS C5- | | C17-PARAFFINS | | WAXY OIL | |
|---|---|---|---|---|---|---|---|---|
| ANALYSES | UNITS | METHOD | Spec | Typical | Spec | Typical | Spec | Typical |
| Congealing Point | ° C. | ASTM938 | — | — | — | — | 26–30 | 28 |
| Cloud Point | ° C. | SASOL | — | — | — | — | — | — |
| Penetration at | | | | | | | | |
| 25° C. | 0.1 mm | ASTM D1321 | — | — | — | — | — | — |
| 40° C. | 0.1 mm | ASTM D1321 | — | — | — | — | — | — |
| 65° C. | 0.1 mm | ASTM D1321 | — | — | — | — | — | — |
| MEK Solubles | mass % | ASTM D721 | — | — | — | — | 22 max | 15 |
| MIBK Solubles | mass % | ASTM D721 | — | — | — | — | — | — |
| Saybolt Color (ASTM) | — | ASTM D156 | — | — | — | — | +10 min | +20 |
| Bromine Index | g Br/100 g | SASOL | — | — | — | — | 10 max | 7 |
| DSC Analyses: | | SASOL | | | | | | |
| Melt range | ° C. | | — | — | — | — | — | — |
| Maximum | ° C. | | — | — | — | — | — | — |
| Fusion Enthalpy | J/g | | — | — | — | — | — | — |
| GPC Analyses: | | SASOL | | | | | | |
| Mn | Daltons | | — | — | — | — | — | 276 |
| Mw | Daltons | | — | — | — | — | — | 272 |
| Mz | Daltons | | — | — | — | — | — | 278 |
| Pd | Daltons | | — | — | — | — | — | 1.0 |
| ASTM D2887 Data: | | ASTM D2887 | | | | | | |
| IBP | ° C. | | — | — | — | — | — | — |
| 5% | ° C. | | — | — | — | 187 | 280–300 | 288 |
| 50% | ° C. | | — | — | — | 258 | — | 328 |
| 95% | ° C. | | — | — | — | 293 | 355–375 | 363 |
| FBP | ° C. | | — | — | — | — | — | — |
| Carbon Distribution: | | SASOL | | | | | | |
| Range | C number | | — | — | 4–18 | 5–18 | — | 13–23 |
| Peak | C number | | — | — | 12–13 | 13 | — | 22 |
| >C17 | mass % | | — | — | 0.15 max | 0.1 | — | — |
| Iso-paraffins | mass % | | — | — | — | — | — | — |

| | | TEST | MEDIUM WAX 1 + 2 | | MEDIUM WAX 3 | | HARD WAX | |
|---|---|---|---|---|---|---|---|---|
| ANALYSES | UNITS | METHOD | Spec | Typical | Spec | Typical | Spec | Typical |
| Congealing Point | ° C. | ASTM938 | 56–60 | 58 | 74–78 | 76 | 97–100 | 99 |
| Cloud Point | ° C. | SASOL | 72 max | 65 | 85 max | 82 | — | — |
| Penetration at | | | | | | | | |
| 25° C. | 0.1 mm | ASTM D1321 | 24–32 | 26 | 15 max | 14 | 1 max | <1 |
| 40° C. | 0.1 mm | ASTM D1321 | 120–130 | 126 | — | — | — | — |
| 65° C. | 0.1 mm | ASTM D1321 | — | — | — | — | 19 max | 13 |
| MEK Solubles | mass % | ASTM D721 | 3.2–4.2 | 3.9 | 15 max | 1.3 | — | — |
| MIBK Solubles | mass % | ASTM D721 | — | — | — | — | 1.0 max | 0.4 |
| Saybolt Color (ASTM) | — | ASTM D156 | +10 min | +19 | +10 min | +17 | +10 min | +14 |
| Bromine Index | g Br/100 g | SASOL | 1 max | 0.5 | 1 max | 0.4 | 0.5 max | 0.2 |
| DCS Analyses: | | SASOL | | | | | | |
| Melt range | ° C. | | 3–7/58–63 | 6/63 | — | 21–78 | 30–34/113–118 | 33/117 |
| Maximum | ° C. | | 53–56 | 54 | — | 67 | 84–88/102/107 | 86/105 |
| Fusion Enthalpy | J/g | | 180–189 | 188 | — | 205 | 230–240 | 235 |
| GPC Analyses: | | SASOL | | | | | | |
| Mn | Daltons | | 351–379 | 365 | — | 448 | 740–770 | 755 |
| Mw | Daltons | | 363–391 | 377 | — | 463 | 910–940 | 925 |
| Mz | Daltons | | 370–398 | 384 | — | 477 | 1208–1238 | 1223 |
| Pd | Daltons | | 1.0–1.1 | 1.0 | — | 1.0 | 1.2 max | 1.1 |

TABLE 4-continued

| ASTM D2887 Data: | | ASTM D2887 | | | | | | |
|---|---|---|---|---|---|---|---|---|
| IBP | ° C. | | — | — | — | — | — | — |
| 5% | ° C. | | 345–365 | 359 | 460–480 | 469 | 530 min | 540 |
| 50% | ° C. | | — | 420 | — | — | — | 676 |
| 95% | ° C. | | 485–505 | 496 | 590–615 | 595 | — | 830 |
| FBP | ° C. | | — | — | — | — | — | — |
| Carbon Distribution: | | SASOL | | | | | | |
| Range | C number | | — | 19–41 | — | 30–55 | — | 45–220 |
| Peak | C number | | — | — | — | — | — | — |
| >C17 | mass % | | — | — | — | — | — | — |
| Iso-paraffins | mass % | | 8 max | 5.9 | 6 max | 4.5 | 4 max | 3.0 |

Product Yields (mass %):
Gas C5- = 0.1
C17- Paraffins = 5.1
Waxy Oil = 11.8
Medium Wax 1 for Blend = 14.2
Medium Wax 2 for Blend = 14.2
Medium Wax 3 = 9.3
Hard Wax = 45.3

The column sump temperature was 330° and the head pressure was 5 mbar (a). The pressure drop achieved over the six beds of Mellapak 250Y packing was 15 mbar (a). All the wax products met the stringent specifications for Fischer-Tropsch products and were consequently usable, as indicated in Table 4 above.

The process 10 permits a light, medium and heavy Fischer-Tropsch derived feedstock to be distilled into normal usable product ranges using a single column with multiple product side streams. This has hitherto not been possible due to high pressure drops associated with conventional packing used in distillation columns. The wax products produced are usable wax products.

The process 10 is capable of producing a wide range of narrow cuts, and also has substantial flexibility.

What is claimed is:

1. A process for distilling paraffinic hydrocarbons to obtain usable wax products comprising the steps of:

feeding a Fischer-Tropsch derived paraffinic hydrocarbon feedstock comprising heavy paraffinic hydrocarbons and, optionally, light paraffinic hydrocarbons, medium paraffinic hydrocarbons or a mixture thereof, into a vacuum distillation column;

withdrawing from the distillation column an overhead stream, a bottom stream comprising wax products, and at least one side stream comprising wax products;

operating the distillation column so that there is substantially no thermal degradation of the feedstock or of the wax products, with the wax products of the bottom stream and of the at least one side stream thus being usable wax products; and obtaining usable wax product from said bottom stream and/or said at least one side stream.

2. A process according to claim 1, wherein the Fischer-Tropsch derived paraffinic hydrocarbon feedstock comprises, in addition to the heavy paraffinic hydrocarbons, the medium paraffinic hydrocarbons and the light paraffinic hydrocarbons.

3. A process according to claim 2, wherein the operation of the distillation column is such that it produces, as the usable wax products, hard wax and medium wax, with the distillation column also producing paraffins.

4. A process according to claim 1, wherein the distillation column has a sump, with the distillation column being operated such that the pressure in the column is from 1 to 12 mbar (a), and the temperature in the column sump is from 190° C. to 350° C., and with the bottom stream being withdrawn from the sump.

5. A process according to claim 4, which includes cooling the bottom stream, and recycling up to 10% by volume of the bottom stream to the sump, as a sump quench.

6. A process according to claim 1, which includes feeding stripping steam into the distillation column, to adjust the relative volatility of components in the feedback.

7. A process according to claim 1, wherein the distillation column contains structured packing as a distillation medium, with the structured packing having a surface area, in $m^3$, ratio of 125:1 to 750:1.

8. A process according to claim 7, wherein a plurality of the side streams are provided, with the distillation column including a draw point or zone for each of the side streams as well as for the overhead and bottom streams, and with a plurality of distillation stages being provided in the distillation column, with each stage comprising the structured packing.

9. A process according to claim 8, wherein the structured packings of the different stages have the same surface area to volume ratios.

10. A process according to claim 8, wherein the structured packings of at least some of the stages have different surface area to volume ratios.

* * * * *